US005904150A

United States Patent [19]

Caristo et al.

[11] Patent Number: 5,904,150

[45] Date of Patent: May 18, 1999

[54] CLEANABLE HAIRBRUSH

[76] Inventors: Christina Caristo; Rocco Caristo, both of 8442 Nicolas Leblanc, Montreal, Quebec, Canada, H1E 3Z6

[21] Appl. No.: 09/055,136

[22] Filed: Apr. 3, 1998

[51] Int. Cl.[6] ..... A45D 24/42

[52] U.S. Cl. ..... 132/119; 15/169; 15/176.4; 15/246; 132/120; 132/152

[58] Field of Search ..... 132/119, 120, 132/148, 152, 153, 154; 15/168, 169, 176.4, 176.5, 184, 246

[56] References Cited

U.S. PATENT DOCUMENTS

| | | | |
|---|---|---|---|
| 1,592,207 | 7/1926 | Havrilla | 15/169 |
| 2,916,757 | 12/1959 | Peilet et al. | 15/169 |
| 3,110,053 | 11/1963 | Surabian | 15/169 |
| 3,577,580 | 5/1971 | Rand | 15/169 |
| 4,152,806 | 5/1979 | Raaf et al. | 15/169 |
| 4,517,703 | 5/1985 | Koke | 132/119 |
| 4,932,425 | 6/1990 | Chen | 132/120 |
| 5,261,426 | 11/1993 | Kellett et al. | 15/104.93 |
| 5,479,951 | 1/1996 | Denebeim | 132/265 |
| 5,519,912 | 5/1996 | Kawamura | 132/119 |

*Primary Examiner*—Todd E. Manahan
*Assistant Examiner*—Eduardo C. Robert
*Attorney, Agent, or Firm*—Eric Fincham

[57] ABSTRACT

A self-cleanable hairbrush comprising three components including a central body portion which has a front major face and a rear major face and with a plurality of apertures extending between the major faces and a handle located at one end thereof. A back member lies adjacent to the rear major face with a plurality of bristles extending from the back member through the apertures in the central body portion while a front member lies in juxtaposition to the front major face of the central body portion and has a plurality of apertures in registry with the apertures in the central body portion. The arrangement provides for a brush which may be readily cleaned and accessorized.

6 Claims, 2 Drawing Sheets

CLEANABLE HAIRBRUSH

BACKGROUND OF THE INVENTION

The present invention relates to a cleanable hairbrush and more particularly, relates to a cleanable hairbrush having interchangeable components.

Hair brushes having a self-cleaning mechanism are known in the art and thus, one may refer to patents illustrating such arrangements including U.S. Pat. Nos. 3,577,580; 5,600,865; and 5,519,912, among others.

While many such structures have been proposed in the art, they do not always provide for easy interchangeability of the components such that different types of accessory brushes may be utilized with the basic structure.

SUMMARY OF THE INVENTION

It is an object of the present invention to provide a hairbrush of the self-cleaning type wherein there are provided for different accessory pieces usable with the main brush structure.

According to one aspect of the present invention, there is provided a self-cleanable hairbrush which comprises a central body portion having a front major face and a rear major face. A plurality of apertures extend through the central body portion between the front major face and the rear major face. A handle is located at one end of the central body portion.

The back member has a back member major face designed to lie in juxtaposition to the rear major face of the central body portion. A plurality of bristles extend from the back member major face, the bristles being located in registry with the apertures in the central body portion. A front member has first and second opposed front member major faces with the first front member major face being designed to lie in juxtaposition to the front major face of the central body portion. A plurality of front member apertures extend between the first and second front member major faces, the front member apertures being arranged so as to be in registry with the apertures in the central body portion.

In greater detail, the self-cleanable hairbrush of the present invention is comprised of three components, the central body portion, a back member and a front member. The central body portion comprises the basic structural component of the hairbrush and includes a handle at one end thereof. The handle may be of any conventional type and may be formed as an integral portion of the central body portion or alternatively, may be suitably secured thereto.

The central body portion may be formed of any suitable material although in preferred embodiments, a molded plastic material is utilized.

The back member is that which carries the hairbrush bristles and to this end, the hairbrush may utilize a plurality of back members, each one having bristles of a different type. Thus, there may be provided a first back member having bristles of a certain length with alternative back members providing bristles of varying lengths and/or configurations.

The front member is the cleaning member and is designed to lie in juxtaposition to the front face of the central body portion. It will have apertures extending therethrough, the apertures being in registry with the apertures of the central body portion and the bristles of the back member.

Suitable means for securing the three components—the back member, central body portion and front member are provided.

BRIEF DESCRIPTION OF THE DRAWINGS

Having thus generally described the invention, reference will be made to the accompanying drawings illustrating an embodiment thereof, in which.

DESCRIPTION OF THE PREFERRED EMBODIMENTS

Figure 1:
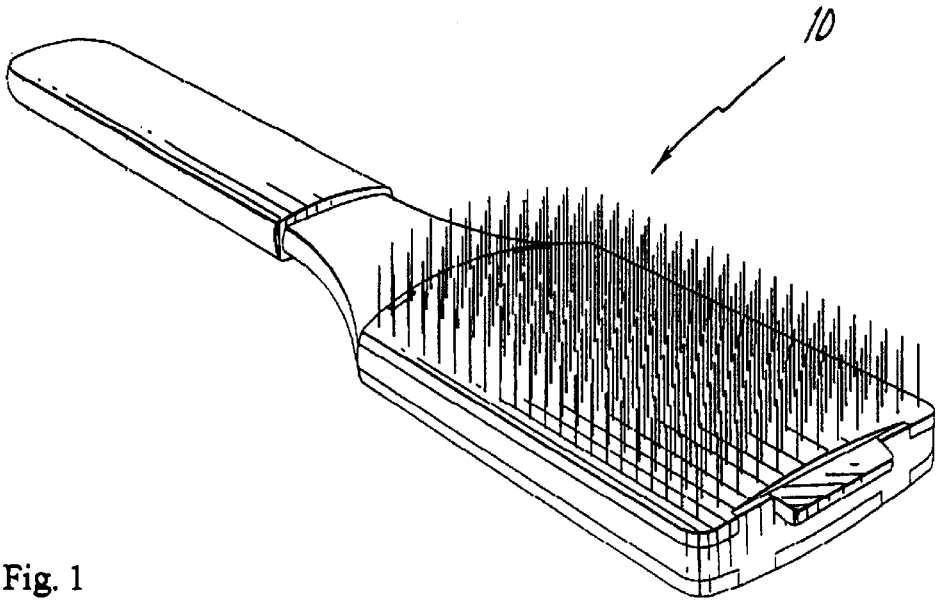
FIG. 1 is a perspective view of a self-cleanable hairbrush according to the present invention.

Referring to the drawings in greater detail and by reference characters thereto, there is illustrated a self-cleanable hairbrush which is generally designated by reference numeral 10 and which includes a front member 12, a back member 14, and a central body portion 16.

Figure 2:
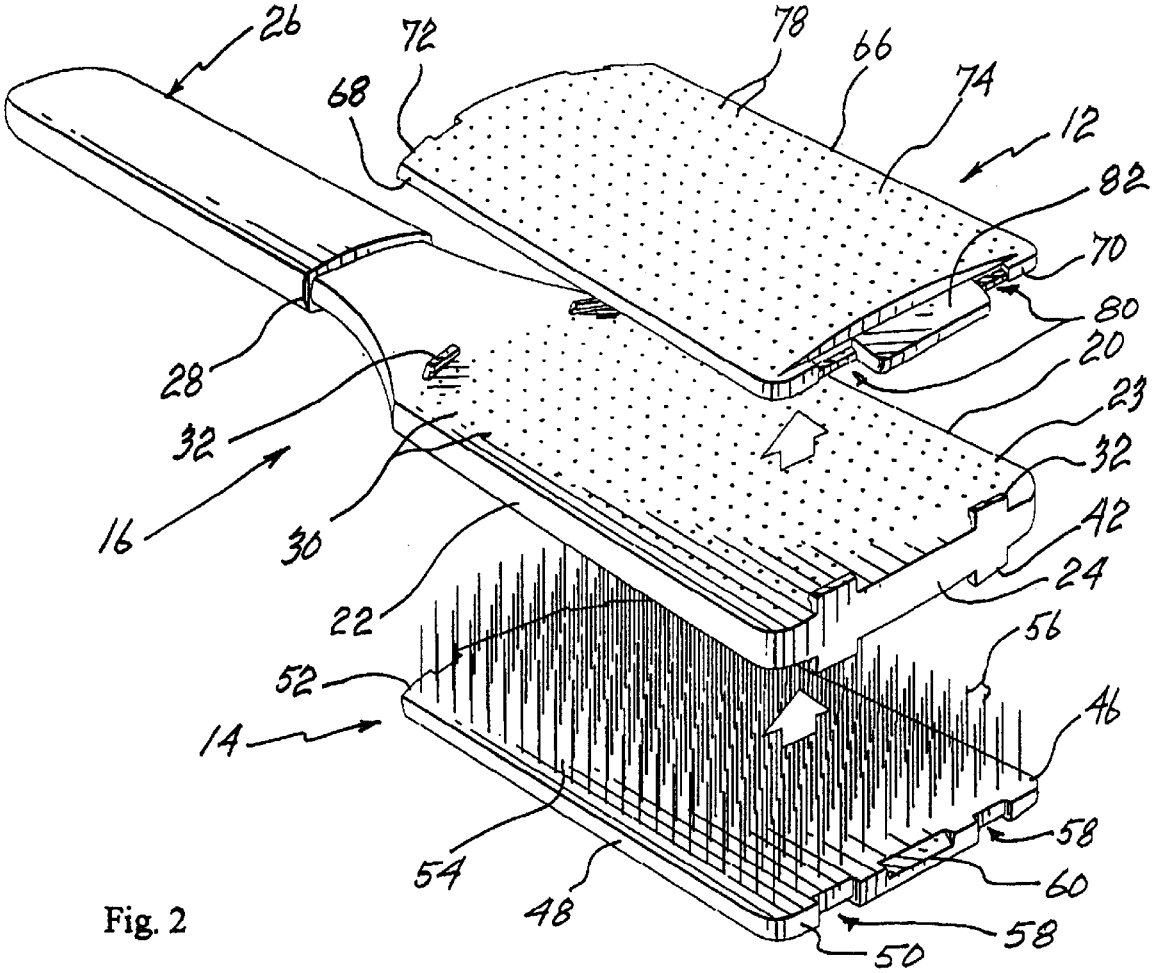
FIG. 2 is an exploded view thereof.
Figure 3:
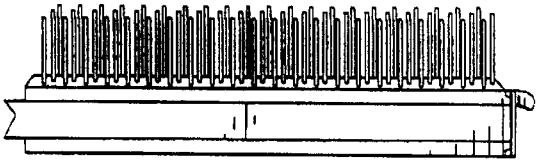
FIG. 3 is a side elevational view of the central body portion.
Figure 4:
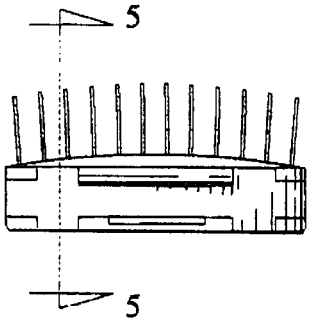
FIG. 4 is an end elevational view as seen from the right hand side of FIG. 1.

Central body portion 16, as may be best seen in FIG. 2, has first and second opposed walls 20 and 22 and an end wall 24. Located at the end opposite end wall 24 is an integrally formed handle 26 having a grip 28 thereon.

Central body portion 16 also includes a front major face 23 and an opposed rear major face 25. A plurality of apertures 30 extend between front major face 23 and rear major face 25.

Figure 6:
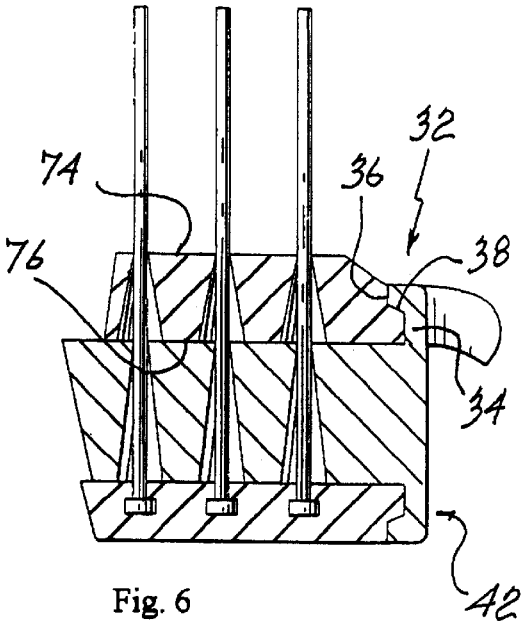
FIG. 6 is a detail view of the right hand side of FIG. 5.

As may be seen in FIG. 2, there are provided four upwardly extending front retaining clips each generally being designated by reference numeral 32 and being substantially identical in structure. One such clip is best illustrated in FIG. 6 and will now be referred to. Front retaining clip 32 includes an upwardly extending wall 34 which terminates in an inwardly extending retaining portion 36 merged with upwardly extending wall 34 by abutment wall 38 which is angled.

There are also provided four such rear wall retaining clips extending downwardly therefrom, each being designated by reference numeral 42.

Back member 14 includes a pair of opposed side walls 46 and 48 and a pair of opposed end walls 50 and 52. Back member 14 is sized to be substantially coextensive with central body portion 16. Back member 14 also includes a major face 54 from which extend upwardly a plurality of bristles 66. Again, as may be best seen in FIG. 2, back member 14 has a pair of recesses 58 formed in each of end walls 50 and 52. Intermediate one pair of recesses 58 is a gripping portion 60.

Front member 12 is sized substantially identical to that of back member 14 and has a pair of opposed side walls 66 and 68 and opposed end walls 70 and 72. Front member 12 also has a first major face 74 and a second major face 76 with apertures 78 extending between front major face 74 and second major face 76.

As was the case with back member 14, there are provided recesses 80 in the end walls with a gripping portion 82 between a pair of such recesses 80.

As illustrated in FIG. 6, apertures 30 in central body portion 16 and apertures 78 in front member 12 are all formed of a somewhat conical configuration.

The brush is assembled as shown in FIG. 1 with major face 54 of back member 14 lying in juxtaposition to rear back major face 25 and bristles 56 extending through apertures 30. Front member 12 may then be placed in position with bristles 56 extending through apertures 78. Each of front member 12 and back member 14 are retained in position by means of front retaining clips 32 and rear retaining clips 42 respectively.

Figure 5:
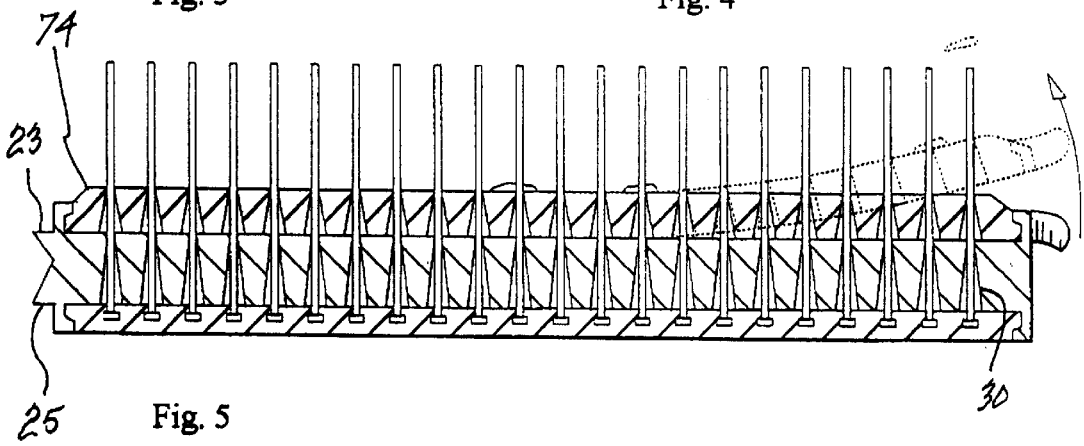
FIG. 5 is a sectional view taken along the line 5—5 of FIG. 4.

When it is desired to clean the hairbrush, and as may be seen in FIG. 5, back member 14 may be removed to release the member from retaining clips 42. Any hair and other debris will then be removed from the bristles and retained by front member 12 for cleaning.

Figure 7:
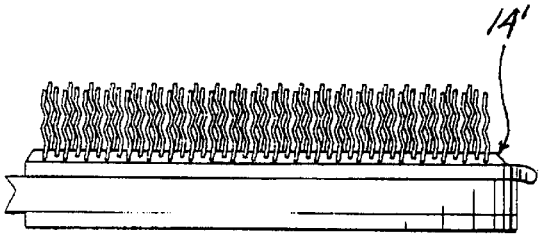
FIG. 7 is a side elevational view similar to FIG. 3 illustrating a different back member.
Figure 8:
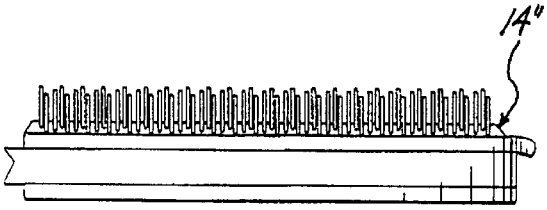
FIG. 8 is a side elevational view similar to FIG. 3 illustrating a still further back member being utilized.

As shown in FIG. 7, there may be provided a different back member 14' which in the illustrated embodiment, utilizes bristles which have a plurality of bends formed therein. Alternatively, as shown in FIG. 8, a still further back member 14" may be utilized wherein the bristles are substantially shorter and/or of a tapered configuration.

It will be understood that the above described embodiment is for purposes of illustration only and that changes and modifications may be made thereto without departing from the spirit and scope of the invention.

We claim:

1. A self-cleanable hairbrush consisting essentially of:

a central body portion having a front major face and a rear major face, a plurality of apertures extending through said central body portion between said front major face and said rear major face, each of said apertures tapering inwardly from said rear major face to said front major face;

a handle being located at one end of said central body portion;

a back member having a back member major face designed to lie in juxtaposition to said rear major face of said central body portion;

a plurality of bristles extending from said back member major face, said bristles being located in registry with said apertures in said central body portion, each of said bristles having a substantially uniform cross sectional configuration;

a front member having first and second opposed front member major faces with said first front member major face being designed to lie in juxtaposition to said front major face of said central body portion;

a plurality of front member apertures extending between said first and second front member major faces, said front member apertures being in registry with said apertures in said central body portion, each of said front member apertures tapering inwardly from said first front member major face to said second front member major face.

2. The self-cleanable hairbrush of claim 1 wherein said apertures in said central body portion have a substantially uniformly tapered conical configuration from said rear major face to said front major face.

3. The self-cleanable hairbrush of claim 2 wherein said front member apertures have a substantially uniformly tapered conical configuration between said first front member major face to said second front member major face.

4. The self-cleanable brush of claim 1 further including means for retaining said front member and said back member in juxtaposition to said central body portion.

5. The self-cleanable brush of claim 4 wherein said means for retaining said front member and said back member comprise a plurality of clips extending outwardly from each of said front and rear major faces of said central body portion adapted to mate with recesses in end walls of said front and back members.

6. The self-cleanable brush of claim 5 further including a handle grip on said handle.

* * * * *